US008967209B2

(12) United States Patent
Ho

(10) Patent No.: US 8,967,209 B2
(45) Date of Patent: Mar. 3, 2015

(54) ADAPTER STRUCTURE FOR A GAS FUEL BOTTLE

(75) Inventor: Yu-Chuan Ho, Taichung (TW)

(73) Assignee: Superior Power Tool Co., Ltd., Taichung (TW)

( * ) Notice: Subject to any disclaimer, the term of this patent is extended or adjusted under 35 U.S.C. 154(b) by 320 days.

(21) Appl. No.: 13/433,798

(22) Filed: Mar. 29, 2012

(65) Prior Publication Data

US 2013/0256257 A1 Oct. 3, 2013

(51) Int. Cl.
*B65D 39/00* (2006.01)

(52) U.S. Cl.
CPC ..... *B65D 39/00* (2013.01)
USPC ..... 141/346; 285/305; 215/228

(58) Field of Classification Search
USPC ..... 141/346, 347, 383, 351, 352, 353, 384, 141/385; 137/332; 251/149.6; 215/228; 285/305, 321, 921
See application file for complete search history.

(56) References Cited

U.S. PATENT DOCUMENTS 3,695,646 A * 10/1972 Mommsen ..... 285/261
4,619,297 A * 10/1986 Kocher ..... 141/20
4,635,974 A * 1/1987 Moussaian ..... 285/305
4,660,803 A * 4/1987 Johnston et al. ..... 251/149.1
4,725,081 A * 2/1988 Bauer ..... 285/305
5,213,309 A * 5/1993 Makishima ..... 251/149.6
5,324,082 A * 6/1994 McNaughton et al. ..... 285/93
5,478,046 A * 12/1995 Szabo ..... 251/149.6
5,511,827 A * 4/1996 Steinkamp et al. ..... 285/39
5,544,858 A * 8/1996 Rogers et al. ..... 251/149.6
5,593,187 A * 1/1997 Okuda et al. ..... 285/305
5,810,366 A * 9/1998 Montjoy et al. ..... 279/43
6,082,779 A * 7/2000 Lesser et al. ..... 285/93
6,533,327 B1 * 3/2003 Twardawski et al. ..... 285/110
6,550,815 B2 * 4/2003 Zitkowic et al. ..... 285/120.1
7,168,451 B1 * 1/2007 Dundas ..... 138/110
7,249,788 B2 * 7/2007 Muhammad et al. ..... 285/319
7,387,140 B2 * 6/2008 Brunn ..... 141/383
2005/0062287 A1 * 3/2005 Lutzke ..... 285/305
2006/0192381 A1 * 8/2006 Moretti et al. ..... 285/305
2009/0165891 A1 * 7/2009 Candelise ..... 141/346
2010/0294798 A1 * 11/2010 Dreveton et al. ..... 222/3
2012/0061953 A1 * 3/2012 Liu ..... 285/305
2013/0256257 A1 * 10/2013 Ho ..... 215/228

* cited by examiner

*Primary Examiner* — Timothy L Maust
*Assistant Examiner* — Andrew Schmid
(74) *Attorney, Agent, or Firm* — Muncy, Geissler, Olds & Lowe, P.C.

(57) ABSTRACT

An adapter structure for a gas fuel bottle cooperates with a bottle and is connected with a power tool. The adapter structure contains a body connecting with the bottle, a gas sealing assembly fixed inside the body, a fixing member cooperating with a spherical connecting portion of the power tool, and a plurality of elastic retaining members secured on the fixing member. Each elastic retaining member forms an elastic spreading mouth, and a diameter of the elastic spreading mouth is normally smaller than that of the spherical connecting portion, the elastic spreading mouth is pressed to expand so that the spherical connecting portion slides into or disengages from the opening. Each of the elastic retaining members is separated from the fixing member, whereby the adapter structure benefits easy die sinking and assembly.

5 Claims, 5 Drawing Sheets

ADAPTER STRUCTURE FOR A GAS FUEL BOTTLE

FIELD OF THE INVENTION

The present invention relates to an adapter structure, and more particularly to an adapter structure for a gas fuel bottle.

BACKGROUND OF THE INVENTION

Many power tools like a nail driver, a hammer, and a stapler are operated by using a gas fuel, such as gas. To carry the power tool easily, a bottle full of gas is connected on the power tool and is disconnected from the power tool when the gas runs out. Accordingly, the bottle is connected on the power tool by using a gas sealing structure to prevent from gas leak and is disconnected by ways of a disconnection structure so as to facilitate a connection of the bottle on the power tool and a disconnection of the bottle from the power tool.

A gas cartridge adapter for fixing the same to a transmission and combustion chamber filling member of a gas fixing device and for disconnecting the same from the member disclosed in U.S. Patent Publication No. 20100294798 contains an adapter structure of a gas bottle to cooperate with a specific power tool. The adapter structure includes two disconnecting and ejecting wings and two fixing legs corresponding to the two disconnecting and ejecting wings, the two fixing legs are served to retain a spherical connecting portion of a power tool, and in a connecting operation, the spherical connecting portion is forced into a chamber between the two fixing legs so that the spherical connecting portion is retained by the two fixing legs further, and in a disconnecting operation, the two disconnecting and ejecting wings are pushed by a pusher so that the two fixing legs deform and then disconnect from the spherical connecting portion, hence the connection and disconnection are achieved.

Nevertheless, each fixing leg has to include a hooked structure formed on an inner surface thereof to match with the spherical connecting portion, but it is difficult to manufacture such a hooked structure in a die sinking process. Besides, the two fixing legs are made of a high resilient material to deform so as to obtain the disconnection of the bottle from the power tool. Also, the adapter structure is integrally formed to match with the two fixing legs made of the high resilient material, having high production cost and less material option.

The present invention has arisen to mitigate and/or obviate the afore-described disadvantages.

SUMMARY OF THE INVENTION

The primary object of the present invention is to provide an adapter structure for a gas fuel bottle that is capable of overcoming difficult die sinking of the conventional adapter structure with hooks.

Another object of the present invention is to provide an adapter structure for a gas fuel bottle that is capable of overcoming inefficient production of the conventional adapter structure made of the same elastic material.

To obtain the above objective, an adapter structure for a gas fuel bottle of the present invention is disposed on a bottle and is connected with a spherical connecting portion of a power tool.

The adapter structure contains a body to connect with the bottle, a gas sealing assembly inside the body, a fixing member to cooperate with the spherical connecting portion, and a plurality of elastic retaining members secured on the fixing member.

The body includes a gas channel connecting with an output end of the bottle.

The gas sealing assembly is mounted in the gas channel and couples with the output end and the spherical connecting portion respectively.

The fixing member includes an opening communicating with the gas channel and is used to receive the spherical connecting portion, a diameter of the opening is larger than that of the spherical connecting portion, the fixing member also includes a plurality of engaging orifices arranged thereon correspondingly;

The plurality of elastic retaining members correspondingly arranged in the plurality of engaging orifices, each elastic retaining member includes an abutting portion and two resilient legs extending from the abutting portion, the two resilient legs is secured on one side of the fixing member away from the opening, and the abutting portions extends into the opening via the engaging orifices, the plurality of elastic retaining member form an elastic spreading mouth corresponding to the opening, and normally a diameter of the elastic spreading mouth is smaller than that of the spherical connecting portion, the elastic spreading mouth is pressed to expand so that the spherical connecting portion slides into or disengages from the opening.

Thereby, the adapter structure for the gas fuel bottle of the present invention has the following advantages:

The spherical connecting portion is fixed through the elastic retaining members after sliding into the opening without using a hooked positioning structure. Thus the adapter structure features easy die sinking and mass production.

The elastic retaining member is separated from the fixing member, so the plurality of elastic retaining members with different elastic forces are capable of providing various options to fulfill various requirements.

The elastic retaining member is separated from the fixing member, so the plurality of elastic retaining members and the fixing member, all of which have different hardness, are capable of providing various material options to lower production cost.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
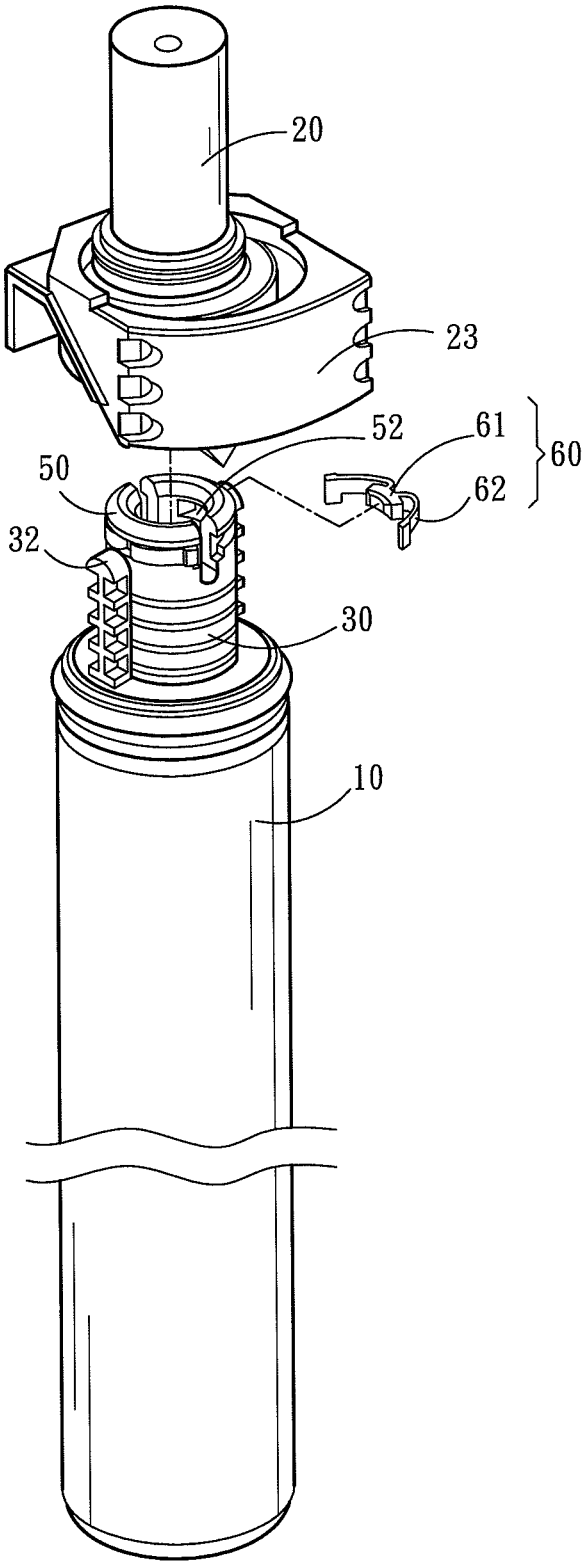
FIG. 1 is a perspective view showing the exploded components of an adapter structure according to a preferred embodiment of the present invention.
Figure 2:
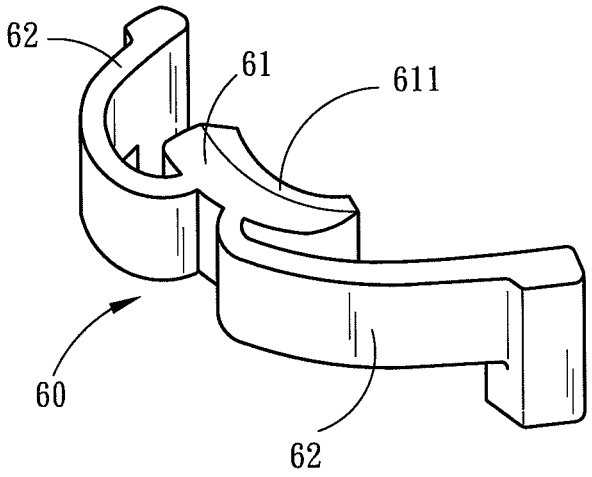
FIG. 2 is a perspective view showing the assembly of an elastic retaining member of the adapter structure according to the preferred embodiment of the present invention.
Figure 3A:
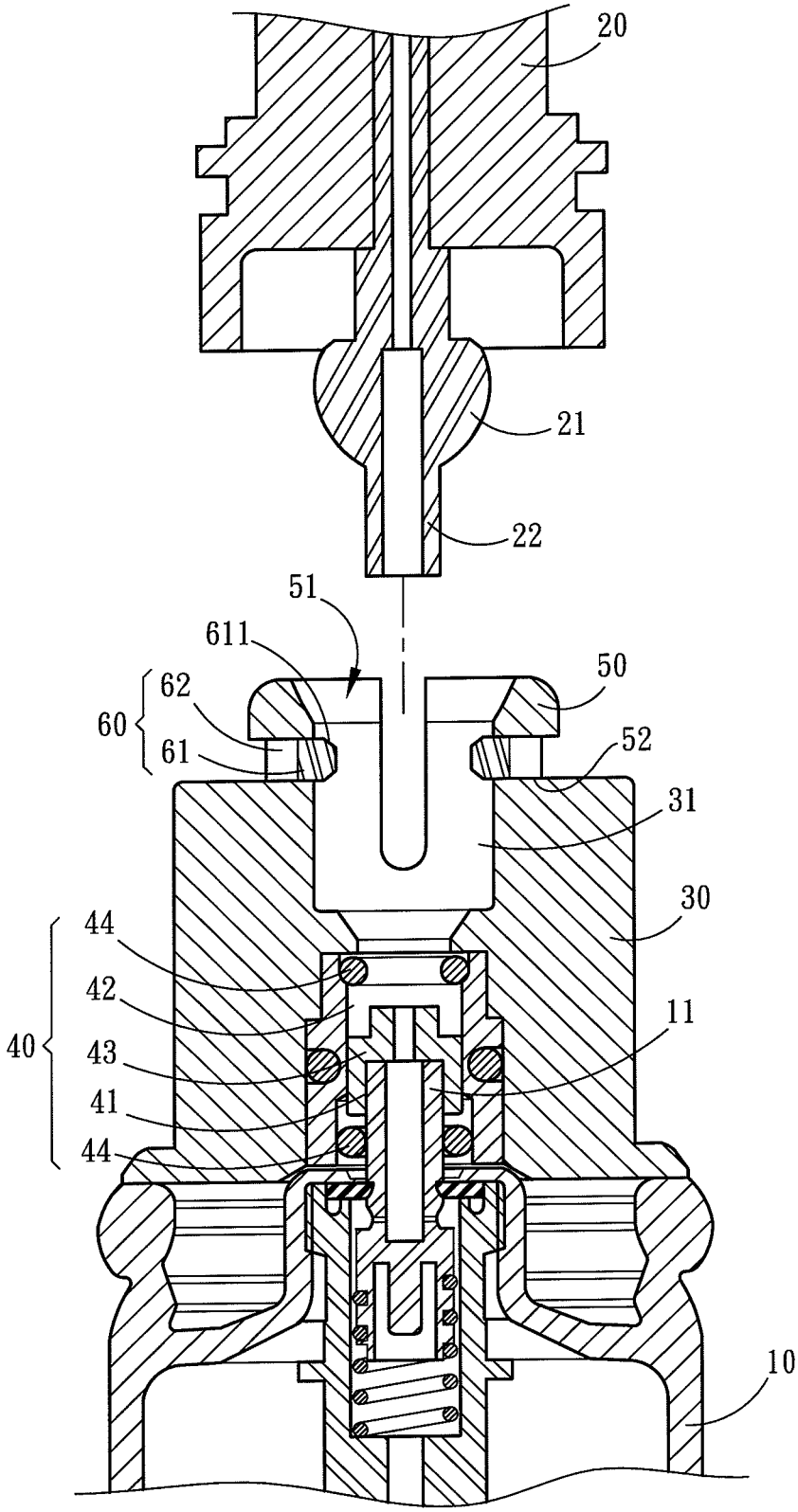
FIG. 3A is a cross sectional view showing the operation of assembling the adapter structure according to the preferred embodiment of the present invention.

With reference to FIGS. 1, 2, and 3A, an adapter structure for a gas fuel bottle according to a preferred embodiment of the present invention is disposed on a bottle 10 and is connected with a spherical connecting portion 21 of a power tool 20, a gas fuel in the bottle 10 is fed into the spherical connecting portion 21 of a power tool 20 through the adapter structure, and the spherical connecting portion 21 has a tubular input end 22 to feed the gas fuel.

The adapter structure comprises a body 30 to connect with the bottle 10, a gas sealing assembly 40 mounted inside the body 30, a fixing member 50 to cooperate with the spherical connecting portion 21, and a plurality of elastic retaining members 60 secured on the fixing member 50. The body 30 includes a gas channel 31 coupled with an output end 11 of the bottle 10. The gas sealing assembly 40 is mounted in the gas channel 31 and respectively couples with the output end 11. and the spherical connecting portion 21. In particular, the gas sealing assembly 40 includes a first connecting hole 41 connecting with the output end 11, a second connecting hole 42 coupling with the tubular input end 22, and a extending connector 43 disposed between the first connecting hole 41 and the second connecting hole 42, each of the first connecting hole 41 and the second connecting hole 42 has an elastic sealing ring 44 arranged on a peripheral side thereof to prevent from gas leakage, and the extending connector 43 is respectively in combination with the output end 11 and the tubular input end 22.

The fixing member 50 includes an opening 51 communicating with the gas channel 31 and used to receive the spherical connecting portion 21, a diameter of the opening 51 is larger than that of the spherical connecting portion 21, the fixing member 50 also includes two engaging orifices 52 arranged thereon correspondingly, two elastic retaining members 60 correspondingly arranged in the two engaging orifices 52, but the number of the engaging orifices 52 is not limited two, for example, three or four symmetrically engaging orifices 52 are capable of being provided in the present invention to correspond to three or four elastic retaining members 60. The plurality of elastic retaining members 60 form an elastic spreading mouth corresponding to the opening 51, and a diameter of the elastic spreading mouth is normally smaller than that of the spherical connecting portion 21, the elastic spreading mouth is capable of being pressed to expand so that the spherical connecting portion 21 slides into or disengages from the opening 51. It is to be noted that the each elastic retaining member 60 includes an abutting portion 61 and two resilient legs 62 extending from the abutting portion 61, the two resilient legs 62 are secured to one side of the fixing member 50 away from the opening 51, and the abutting portion 61 extends into the opening 51 via the engaging orifice 52.

Figure 3B:
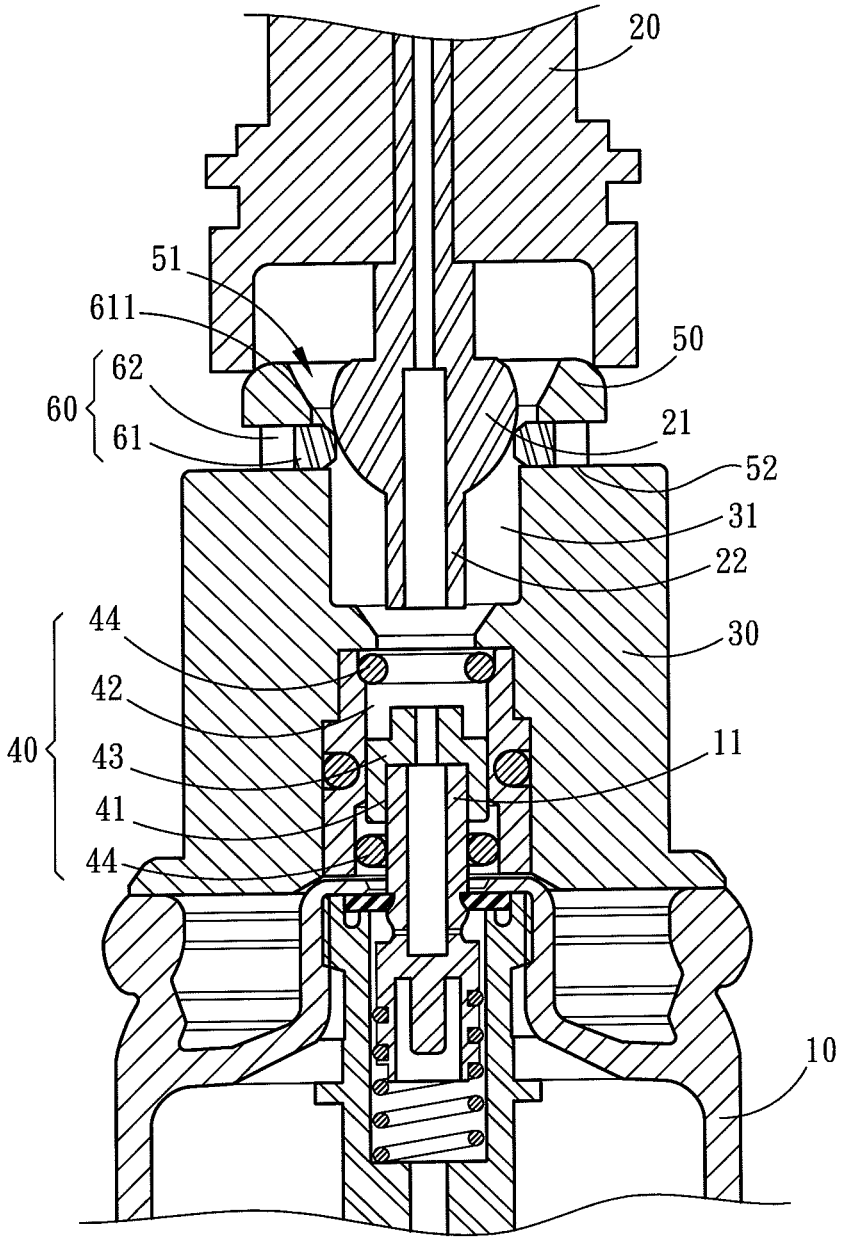
FIG. 3B is anther cross sectional view showing the operation of assembling the adapter structure according to the preferred embodiment of the present invention.
Figure 3C:
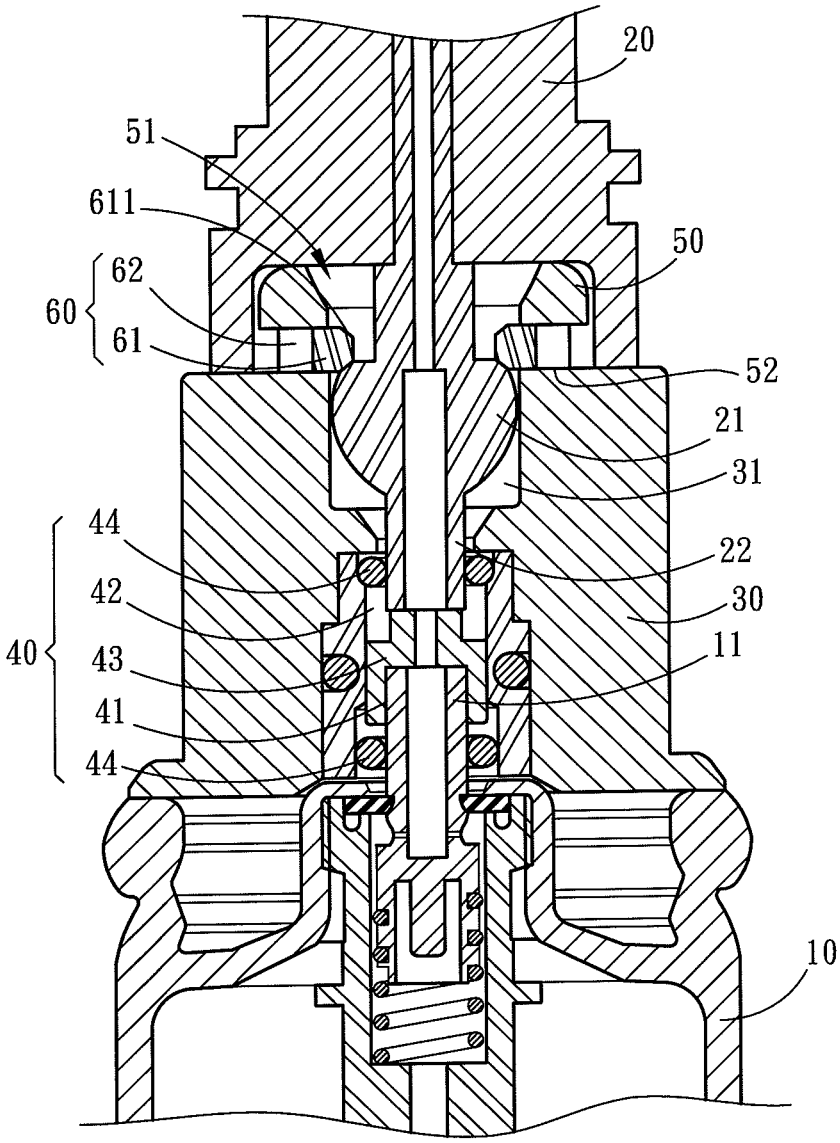
FIG. 3C is also anther cross sectional view showing the operation of assembling the adapter structure according to the preferred embodiment of the present invention.

Furthermore, as shown in FIG. 1, the power tool 20 includes a releasable pressing member 23 The body 30 includes two disconnecting portions 32 connected on a surface of one side thereof away from the output end 11 so that a user presses the releasable pressing member 23 to force the two disconnecting portions 32, such that the spherical connecting portion 21 disconnects from the fixing member 50. As illustrated in FIGS. 3A and 3C, an operation of assembling the adapter structure for the gas fuel bottle is described as follows.

Referring to FIG. 3A, as connecting the power tool 20 to the bottle 10, the spherical connecting portion 21 is inserted into the opening 51 of the fixing member 50. Due to the diameter of the elastic spreading mouth is normally smaller than that of the spherical connecting portion 21, so as shown in FIG. 3B, the spherical connecting portion 21 enters into the spherical connecting portion 21 to press the abutting portion 61 of the each elastic retaining member 60 expending outward so that the diameter of the elastic spreading mouth becomes increased with that of the spherical connecting portion 21, thereafter the spherical connecting portion 21 enters into the opening 51 as illustrated in FIG. 3C, and the tubular input end 22 couples with the second connecting hole 42 of the gas sealing assembly 40 via the gas channel 31 to communicate with the output end 11 of the bottle 10 so that the power tool 20 has the gas fuel of the bottle 10 to operate, and the each elastic retaining member 60 returns to an original state with the diameter of the elastic spreading mouth decreasing so that the spherical connecting portion 21 is fixed in the gas channel 31.

Likewise, as removing the bottle 10 from the power tool 20, the releasable pressing member 23 is pressed to push the two disconnecting portions 32 so that the spherical connecting portion 21 forces the each elastic retaining member 60 reversely to expand the diameter of the elastic spreading mouth, thus removing the each elastic retaining member 60 from the fixing member 50. To facilitate convenience of a connection and a disconnection, as shown in FIG. 2, the abutting portion 61 further includes two arcuate chamfers 611 corresponding to the spherical connecting portion 21 so that the spherical connecting portion 21 pushes the abutting portion 61 away easily, thus obtaining the connection and disconnection.

Thereby, the adapter structure for the gas fuel bottle of the present invention has the following advantages:

1. The spherical connecting portion is fixed through the elastic retaining members after sliding into the opening without using a hooked positioning structure. Thus the adapter structure features easy die sinking and mass production.

2. The each elastic retaining member is separated from the fixing member, so the plurality of elastic retaining members with different elastic forces are capable of providing various options to fulfill various requirements.

3. The each elastic retaining member is separated from the fixing member, so the plurality of elastic retaining members and the fixing member, all of which have different hardness, are capable of providing various material options to lower production cost.

4. The spherical connecting portion forces the each elastic retaining member easily by means of the two arcuate chamfers, thus having quick connection and disconnection.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An adapter structure for a gas fuel bottle, connected with a spherical connecting portion (21) of a power tool (20) along an assembling direction that the adapter structure moves toward the spherical connecting portion (21) of the power tool (20), the adapter structure comprising:

a body (30) connecting with a bottle (10), the body (30) including a gas channel (31) coupled with an output end (11) of the bottle (10);

a gas sealing assembly (40) mounted in the gas channel (31), the gas sealing assembly (40) respectively connecting with the output end (11) and the spherical connecting portion (21);

a fixing member (50) located at the top of the body (30) for fastening the spherical connecting portion (21), the fixing member (50) including an opening (51) communicating with the gas channel (31) and used to receive the spherical connecting portion (21), a diameter of the opening (51) being larger than that of the spherical connecting portion (21), the fixing member (50) also including a plurality of engaging orifices (52) running through an inner wall and an outer wall of the fixing member (50) and communicating with the gas channel (31) and the opening (51), each of the plurality of engaging orifices (52) including an upper engaging surface and a lower engaging surface that are perpendicular to the assembling direction and parallel with each other;

a plurality of elastic retaining members (60) separably mounted on the fixing member (50) and correspondingly arranged in the plurality of engaging orifices (52), each elastic retaining member (60) including an abutting portion (61) and two resilient legs (62) extending from the abutting portion (61), the two resilient legs (62) being secured on the outer wall of the fixing member (50), and the abutting portions (61) extending into the opening (51) via the engaging orifices (52) and abutting the upper engaging surface and the lower engaging surface to restrain the elastic retaining member (60) from moving along the assembling direction, the plurality of elastic retaining members (60) forming an elastic spreading mouth corresponding to the opening (51), and a diameter of the elastic spreading mouth being smaller than that of the spherical connecting portion (21), the elastic spreading mouth being pressed to expand so that the spherical connecting portion (21) slides into or disengages from the opening (51).

2. The adapter structure for the gas fuel bottle according to claim 1, wherein the spherical connecting portion (21) includes a tubular input end (22), the gas sealing assembly (40) includes a first connecting hole (41) connecting with the output end (11), a second connecting hole (42) connecting with the tubular input end (22), and an elastic sealing ring (44) respectively arranged on a peripheral of the first connecting hole (41) and the second connecting hole (42).

3. The adapter structure for the gas fuel bottle according to claim 2, wherein the gas sealing assembly (40) further includes an extending connector (43) disposed between the first connecting hole (41) and the second connecting hole (43), and the extending connector (43) is respectively in combination with the output end (11) and the tubular input end (22).

4. The adapter structure for the gas fuel bottle according to claim 1, wherein the abutting portion (61) further includes two arcuate chamfers (611) corresponding to the spherical connecting portion (21).

5. The adapter structure for the gas fuel bottle according to claim 1, further comprising two disconnecting portions (32) connected on a surface of one side of the body (30) away form the output end (11).

* * * * *